US005732726A

United States Patent [19]

Lee

[11] Patent Number: 5,732,726

[45] Date of Patent: Mar. 31, 1998

[54] CABIN TENT POLE SYSTEM

[75] Inventor: Youn J. Lee, Kyong Ki-Do, Rep. of Korea

[73] Assignee: Jinwoong, Inc., Rep. of Korea

[21] Appl. No.: 590,463

[22] Filed: Jan. 23, 1996

[51] Int. Cl.[6] ..... A45F 3/00; E04H 15/00

[52] U.S. Cl. ..... 135/156; 135/114; 135/120.3; 135/124; 135/157; 135/158

[58] Field of Search ..... 135/156, 114, 135/158, 157, 98, 87, 121, 124, 119, 120.1, 120.3

[56] References Cited

U.S. PATENT DOCUMENTS

| | | | |
|---|---|---|---|
| 2,742,912 | 4/1956 | Blanchard | 135/156 X |
| 3,181,542 | 5/1965 | Bareis | 135/98 |
| 3,182,672 | 5/1965 | Biller, Jr. | 135/156 X |
| 3,424,178 | 1/1969 | Yazaki | 135/157 |
| 3,499,457 | 3/1970 | Waring et al. | 135/156 X |
| 4,077,418 | 3/1978 | Cohen | 135/157 X |
| 4,192,333 | 3/1980 | Sato | 135/156 X |
| 4,352,362 | 10/1982 | Nichols | 135/98 |
| 4,706,696 | 11/1987 | Gillis | 135/98 X |
| 4,941,499 | 7/1990 | Pelsue et al. | 135/156 X |
| 5,002,083 | 3/1991 | Kim | 135/98 |

OTHER PUBLICATIONS

Camp the Outdoor World of Camel, 1975 p. 10 "Nylon Umbrella".

*Primary Examiner*—Wynn E. Wood

*Attorney, Agent, or Firm*—Raymond E. Roberts; Michael J. Hughes

[57] ABSTRACT

A cabin tent pole system (10) using side poles (14), gable poles (16), corner hubs (18), and roof hubs (20). The corner hubs (18) have two tubular members (50) which join forming a first obtuse angle (32), where a structural web (56) may be provided to help maintain the first obtuse angle (32) and strengthen the corner hub (18). Similarly the roof hubs (20) have tubular members (60) which form second obtuse angles (34) between any pair of the tubular members (60). The roof hubs (20) may include a series of webs (66) which act to maintain the angular relationships of the tubular members (60), including the second obtuse angles (34). Only larger embodiments of the tent pole system (10) require the use of ridge poles (40).

5 Claims, 3 Drawing Sheets

CABIN TENT POLE SYSTEM

TECHNICAL FIELD

The present invention relates generally to cabin tent support structures, and more particularly to tent pole and hub systems.

BACKGROUND ART

One of the earliest forms of shelter known to humankind is the tent. Huge variety in tent design exists, but common elements include tent fabric and tent poles which shape and support the fabric. Most tents use multiple tent poles, often with hubs connecting the tent poles together. It therefore becomes the combination of poles and hubs which define many characteristics of such tents. Examples of important characteristics include structural shape, rigidity, ability to support the tent fabric, and reaction to externally applied stresses such as those caused by bumping into the tent or from wind buffeting the tent and causing the walls to vibrate.

For purposes of the following discussion, tent poles will be classed as side poles, gable poles, ridge poles, and horizontal poles. In assembled tents, side poles extent in a generally vertical orientation from the ground surface up to the beginning of the roof region of a tent. Gable poles extend from the edge of a tent roof upward to the peak of the tent roof, and have a sloping orientation (i.e., generally in the range of 30 to 60 degrees relative to horizontal). Ridge poles are generally horizontal, but for discussion here are strictly defined as being at the peak of the tent roof (the term tie pole is sometimes used for this). Finally, horizontal poles are herein strictly defined as including all generally horizontally oriented poles except ridge poles (e.g., they include poles typically use at the eaves or lower roof edges of some tent designs).

Balancing tent pole system characteristics is not an easy engineering task. Some of the already mentioned characteristics urge contradictory engineering solutions. For example, strong rigid shapes generally are best accomplished by framing the shape in closed geometric shapes, such as the triangular and rectangular members used in engineering wire-frame drawings. See e.g., the rectangles 2 in FIG. 3 (prior art). Unfortunately, while framed sections are strong and rigid, they also transmit force and vibration very well, often to where it is undesirable. Further, framed sections may require more parts than other designs (e.g., FIG. 1 and 2 do not use the horizontal poles 4 of FIG. 3 (prior art)), and therefore may result in increased overall tent weight and cost. Thus, optimizing only some characteristics may conflict with general goals for an entire tent system.

For discussion here, tent pole systems can be defined as free standing, pre-stressed, and gravity assisted systems. In the market today, the free standing system is used primarily for larger tents (including yurts, and show tents); the pre-stressed construction is used primarily in smaller shorter type one and two person portable tents; and, gravity assisted systems are primarily used for cabin tents (i.e., tents large enough to accommodate at least a small family, and usually tall enough that an average adult can stand fully upright in the tent center). A good example of a free standing tent system is the tepee. It has a very strong and rigid frame over which fabric is draped. However, the fabric adds nothing to the strength or shape of the finished tepee. When designing tepees the tent fabric and the tent pole system are effectively two unrelated problems. At an opposite extreme are pre-stressed pole systems, good examples of these can be found today in tents using fiberglass poles which are bent into place during assembly and held together by the tent fabric in a spring-like manner to define the tent structure. Attempting to assemble such a tent with only the poles and hubs (if any) would be impossible, or at best produce a very flimsy structure. Finally, viewable as falling between the free standing and pre-stressed; systems are gravity assisted systems. Many cabin tents in the market today fall into this classification. In such tents the poles do not form as strong a system as when no tent fabric is assembled onto them, nor are the tent poles intentionally bent in the manner of springs to assemble and tension the tent. Rather, once assembled onto a finished tent, the fabric under the weight of gravity helps to define and stabilize the final tent structure. In such tents the critical components become the hubs used to connect the tent poles, since it is in these that forces concentrate and must be accommodated.

Various forces are applied to tent hubs, either directly, or more commonly indirectly, through the tent poles inserted into the hubs. One is fabric weight, which actually may be variable, since, rain, snow, and other substances can "weigh down" tent fabric. External stresses form another group of forces which also ultimately reach the hubs. Assembled tents may be bumped into by users who are either inside or outside of the tent. And when present, wind may range from constantly pressing against the tent from one direction to buffeting it from rapidly changing directions at different speeds, thereby causing vibration in the tent structure. It therefore follows that for a cabin tent design to be acceptable the hubs which are used must successfully deal with all of these forces.

Additional concerns for many tent designs are parts count and overall tent weight. Parts count has already been alluded to above in noting that the designs in FIG. 1 and 2 do not use the horizontal poles 4 of the design in FIG. 3 (prior an). Reducing parts count has the obvious advantage that viewer parts mean that there are less to lose or misplace. It almost always reduces cost also, particularly if the eliminated parts are tent poles made of aluminum. And, usually, it leads to a more intuitive assembly process, and sometimes a simpler one as well. Further, it may strongly affect tent weight. Generally, of the three major components used in cabin tents the fabric is least dense, the hub has intermediate density (at least in plastic hubs, as are preferred today), and the poles are most dense, since they are metal or high density plastic like fiberglass. There are, of course, also notable size differences in these components. For example, hubs and poles are markedly different in size. Thus, by accepting some size increase in smaller less dense parts, to eliminate some high density large parts entirely, an overall weight savings may be accomplished by selective parts count reduction.

From the above discussion it should be clear that tent design has to balance many factors, and that key components to concentrate upon are the hubs used to hold together the tent poles which support tents.

DISCLOSURE OF INVENTION

Accordingly, it is an object of the present invention to provide a cabin tent pole system using fewer parts.

Another object of the present invention is to provide a cabin tent pole system which is economically produced.

Another object of the present invention is to provide a cabin tent pole system which is simple to use.

Another object of the present invention is to provide a cabin tent pole system which is strong.

And, another object of the present invention is to provide a cabin tent pole system which dampens transmission of randomly applied forces.

Briefly, a preferred embodiment of the present invention is a cabin tent pole system formed from a number of tent side poles, having two opposite ends; a number of tent gable poles, also having two opposite ends; a number of corner hubs, having two pole ports; and a roof hub having a number of pole ports. Each corner hub receives an end of a side pole in one pole port, and an end of a gable pole in the other pole port. All ends of gable poles, which are not inserted into corner hubs, are inserted into pole ports of the roof hub. A key feature of the invention is that no horizontal poles between corner hubs are used. Another key feature is that all pole-hub-pole junctures define obtuse angular relationships.

An advantage of the present invention is that it may be implemented with fewer parts. Only for larger embodiments of the present invention are any ridge poles used, and the invention uses no horizontal poles at all. The present invention instead transfers duties of prior art horizontal poles to the hubs. Tent poles are generally large, and weighty due to being made of high density materials, like metal. In contrast, tent hubs are generally smaller and less weighty, due to construction usually being of low density materials like plastic. It follows that the present invention may facilitate design of lighter tents.

Peripheral advantages to the above described fewer parts requirement include less potential for parts to become lost or mislaid by users, and simpler and often more intuitive assembly of tents using the present invention.

Another advantage of the present invention is that tents utilizing it may be produced more economically. Tent poles are typically made of metal, with aluminum being a frequent but relatively expensive choice. In contrast hubs are typically made of plastic, which is relatively cheap. It follows that by eliminating the need for some tent poles, in favor of redesigned hubs, overall tent costs may be reduced by use of the present invention.

Another advantage of the present invention is that tents utilizing it may be made sufficiently strong, yet may better handle random applications of external force of varying intensity, direction, and frequency (e.g., blows by users stumbling into the tent or wind buffeting it). By elimination of rigidly framed sections, force applied at one point on the tent structure is not easily transferred throughout the entire tent structure. Further, due to the use of flexible hub webs, force that is applied to a tent using the present invention gets absorbed and dampened much more quickly.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
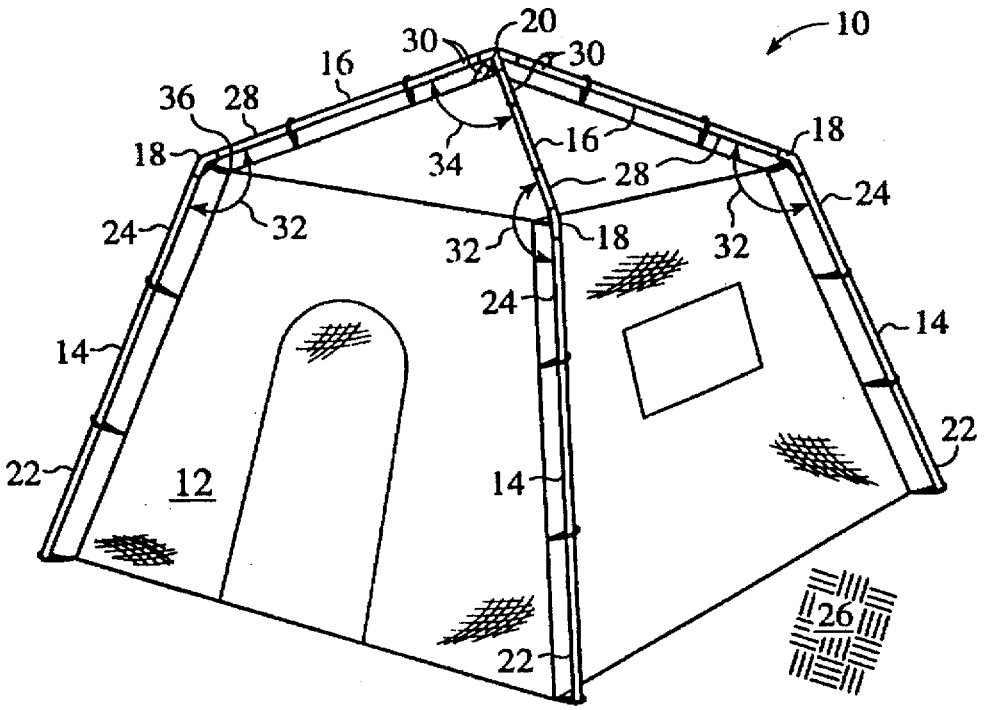
FIG. 1 is a perspective view of a tent using the inventive tent pole system.

The preferred embodiment of the present invention is a cabin tent pole system. As illustrated in the various drawings, and particularly in the view of FIG. 1, a basic form of the preferred embodiment of the invention is depicted by the general reference character 10.

Figure 2:
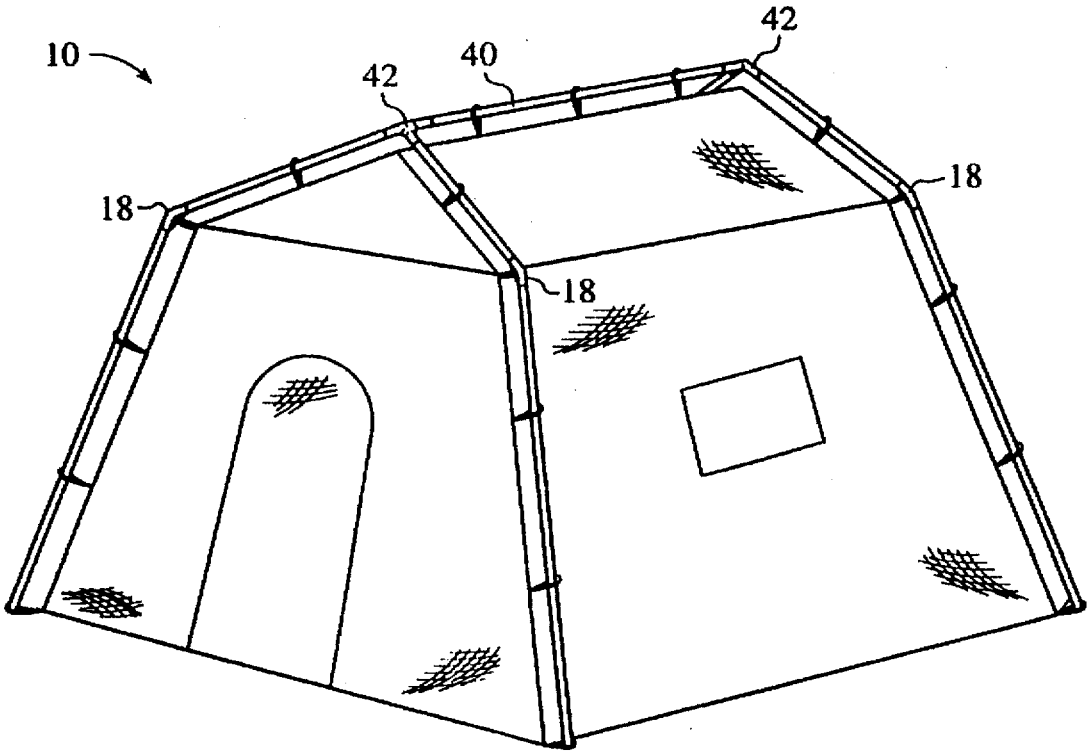
FIG. 2 is a stretched variation of the system portrayed in FIG. 1.

FIG. 1 depicts the pole system of a tent 12 using the present invention 10. The tent 12 includes four side poles 14, four gable poles 16, four instances of two-tube corner hubs 18, and one instance of a four-tube roof hub 20. Each side pole 14 has defined therein a lower end 22 and an upper end 24. The lower end 22 of each side pole 14 extends generally from the surface 26 upon which the tent 12 is assembled, while the upper end 24 of each side pole 14 is inserted into a corner hub 18, at the lower edge of the tent roof. Similarly, each gable pole 16 has an outer end 28 and an inner end 30. The outer end 28 of each gable pole 16 is also inserted into a corner hub 18, while the inner end 30 of each gable pole 16 is inserted into the roof hub 20. When properly assembled, respective side poles 14 and gable poles 16 are inserted into each corner hub 18 and define a first obtuse angle 32. Similarly, when inserted into the roof hub 20, pairs of gable poles 16 each define a second obtuse angle 34. First obtuse angles 32 and second obtuse angles 34 may measure the same or they may be different. Further, while in the inventor's preferred embodiment all first obtuse angles 32 are the same and all second obtuse angles 34 are the same, there is no reason that this is necessary, or a limitation FIG. 2 illustrates a variation on the tent pole system 10 suitable for constructing larger tents. A ridge pole 40 is added between two instances of three-tube roof hubs 42. Otherwise the components of the tent 12 in FIG. 2 remain generally the same as in FIG. 1.

Still other variations on the tent pole system 10 are easily envisioned. For example, rather than the generally square-base pyramidal tent 12 in FIG. 1, pole system for a triangular-base tent is possible using three each of the side poles 14, gable poles 16, and corner hubs 18, but connecting them with one instance of a hub such as the three-tube roof hubs 42 of FIG. 2. Further, it should now be clear that by using combinations of three-tube roof hubs 20 and four-tube roof hubs 42, it is possible to construct other tent shapes which are even more complex (e.g., "L" and "T" shapes).

Figure 3:
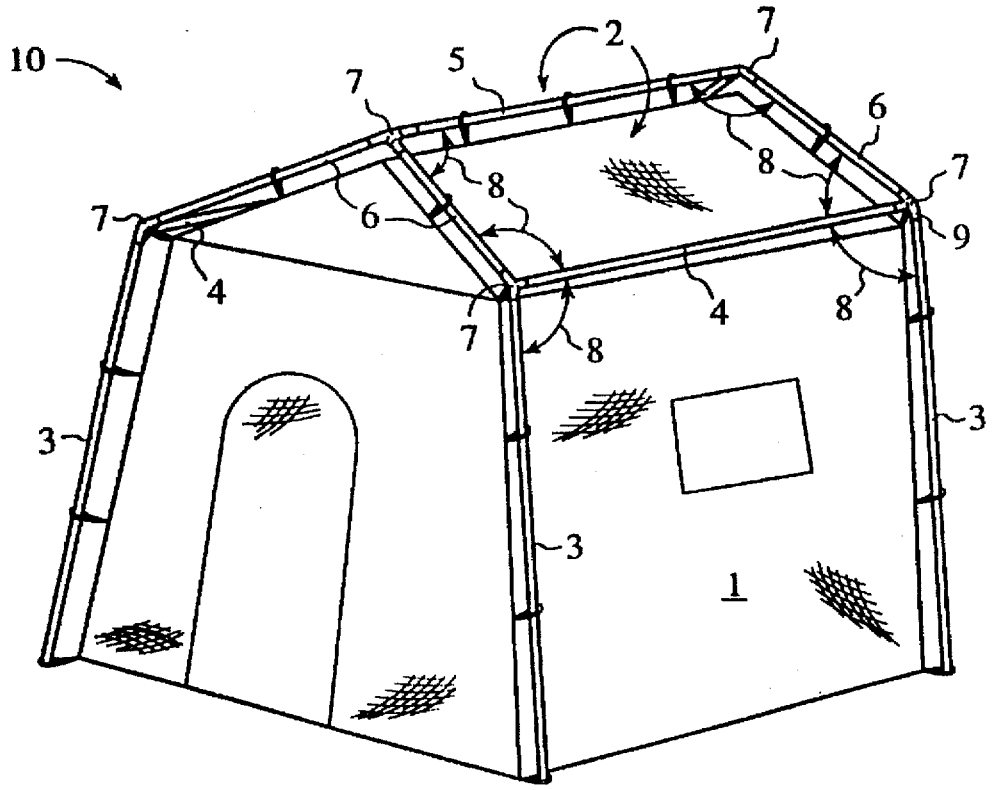
FIG. 3 (PRIOR ART)
FIG. 3 (prior art) illustrates tent pole system using a partial rigid frame.

The keys to the present invention 10 are the two-tube corner hubs 18 and the multi-tube roof hubs (defined for purposes herein as hubs having more than two tubular members). Possible examples include the four-tube roof hub 20 (of FIG. 1) the three-tube roof hubs 42 (of FIG. 2), and other roof hubs having even larger numbers of tubes (not shown). While hubs have, of course, been previously used for constructing tents, the inventor knows of no system using hubs having the obtuse angle feature at every pole-hub-pole juncture in a tent, nor in the same manner as described below. FIG. 3 (prior art) can be used to illustrate both of these points.

In FIG. 3 (prior art), the tent 1 has a roof framed by two rigid rectangles 2 formed by horizontal poles 4, ridge pole 5, and gable poles 6. The roof rectangles 2 are supported by side poles 3. Holding all of these poles together are three-tube hubs 7. It can readily be appreciated that the side poles 3 and the horizontal poles 4, the horizontal poles 4 and the gable poles 6, and the ridge pole 5 and the gable poles 6 all define right angles 8, and right angles are not as desirable as obtuse angles for handling force (described further below). Further, structures such as the rigid rectangles 2 are excellent for transferring stress. Unfortunately they do this too well for the purposes of many tent designs, transferring all stress along the poles defining their sides to all other points of the parallelogram, and on into other connected rigid bodies, such as the hubs 7, poles 4, 5 and 6 forming other connected rectangles 2, and down into the side poles 3. For example, striking the tent 1 at point 9 would causes the entire tent 1 to shake. In contrast, striking tent 12, in FIG. 2, at point 36 with a similar force would cause less shaking, since there are fewer paths for transmission of the force of the blow, and that shaking would dampen more quickly, since the forces resulting from the blow would better be absorbed in the webs (also discussed below) of the hubs 18 and 20 connecting the tent poles 14 and 16.

Figure 4:
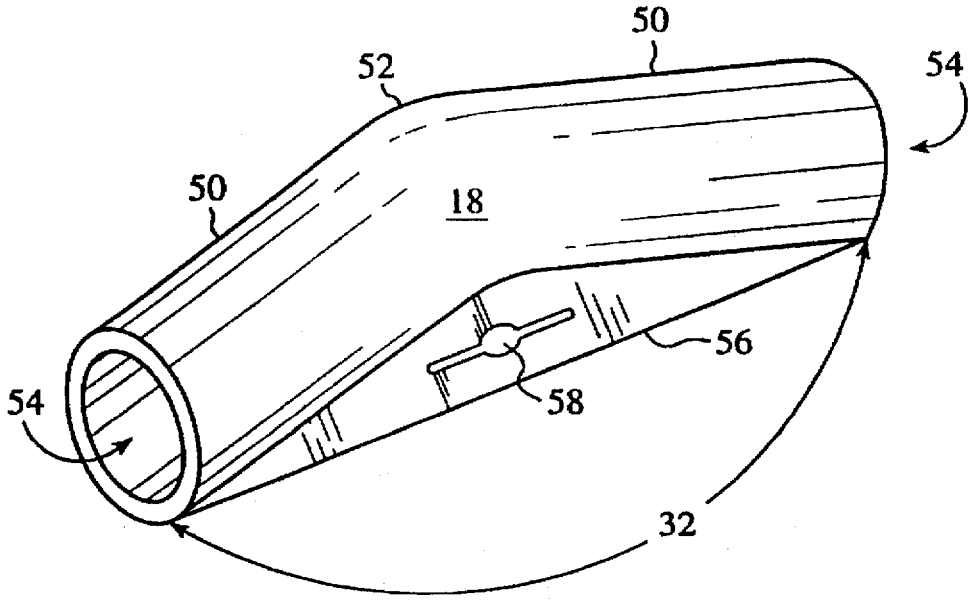
FIG. 4 illustrates a corner hub suitable for use in the inventive tent pole system; and, FIG. 5 illustrates a roof hub suitable for use in the inventive tent pole system.

FIG. 4 illustrates a preferred embodiment of the corner hub 18, having two tubular members 50 connected together at a junction 52. Ports 54 are located at ends of each tubular member 50 opposite the junction 52, and accept insertion of either an upper end 24 of a side pole 14 or the outer end 28 of a gable pole 16 (the poles are shown in FIG. 1 ). While the embodiment shown here depicts the ports 54 as being the same size, to accept insertion of similar sized upper ends 24 and outer ends 28, there is no reason this must be the case. The connected tubular members 50 form first obtuse angle 32, the same first obtuse angle 32 noted in FIG. 2. The fact that this angle is obtuse adds to the ability of the corner hub 18 to handle its role in tent support structures. Since opposing forces cancel, and obtuse angle hubs direct forces into partially opposing relationships, it follows that obtuse angle hubs help to cancel out some forces. Any force which is not canceled in an obtuse angle hub, in this manner, is also better transferred into attached poles and thereby into other hubs, where it then may be suitably dealt with. The net result is that hubs such as the corner hub 18 are able to handle more force than otherwise structurally equivalent right angle and acute angle hubs would, and what force they do transmit is transmitted more efficiently.

Occupying the general region of the first obtuse angle 32 in the preferred embodiment of the corner hub 18 is a structural web 56. The web 56 functions in the conventional manner of webs, gussets, and buttresses serving to strengthen the corner hub 18. In this manner particular rigidity and strength to maintain the first obtuse angle 32 relationship between the members 50 is accomplished. Further, since the preferred material of the corner hubs 18 is plastic, the web 56 has a degree of flexibility which dampens forces transmitted into them by either side poles 14 and gable poles 16. An optional feature of the web 56 is an attachment orifice 58, to which materials such as tent walls, canopies, etc. may be attached when a tent is assembled (an entirely conventional feature found in some form in many prior art hub designs). Finally, it should be appreciated that the web 56 is optional, but preferred since omitting it requires a much stronger construction of the rest of the corner hub 18.

Figure 5:
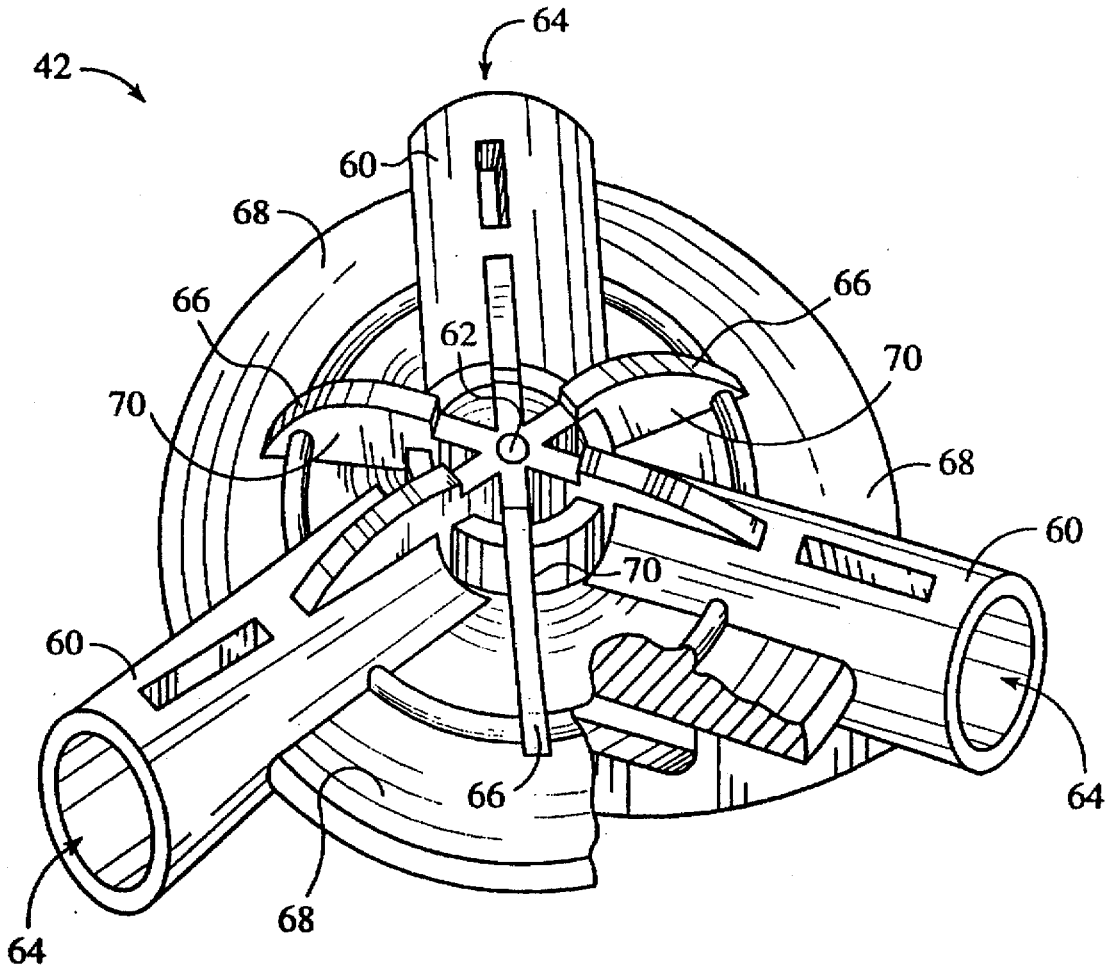

FIG. 5 illustrates a preferred embodiment of a roof hub 42. The roof hub 42 has three tubular members 60 which connect at a junction 62. Ports 64 are located at ends of each tubular member 60, opposite the junction 62. While the depiction in FIG. 5 implies that the ports 64 are all similarly sized, this is not necessary, and may vary as particular applications require. A variety of strengthening mechanisms are possible for use with the roof hub 42, the only point critical to the spirit of the invention being that the members 60 are held in relatively fixed angular relationships to one another in all dimensions. FIG. 5 depicts an implementation using a number of webs 66 (here also optional, but preferred) to accomplish this. Large webs 68 between the individual members 60 give the roof hub 42 a conical appearance and strongly hold the members 60 in position within that cone, i.e., they maintain a circumferential relationship. Small webs 70 are used to further brace the members 60 off of the large webs 68, and thereby strongly hold the members 60 so that the cone is not collapsed inward, i.e., they maintain the second obtuse angle 34 relationship desired between every pair of tubular members 60. Here also, construction of roof hubs 42 from a material such as plastic imparts a degree of flexibility which helps dampen forces transmitted into them from the gable poles 16.

The preferred roof hub 42 can be seen from FIG. 5 to be a component which has substantial strengthening added (e.g., the webs 66). This is necessary to form a strong tent support system when horizontal braces such as the horizontal poles 4 of FIG. 3 (prior art) are not used. However, building up one component (i.e., the roof hub 42) is a very worthwhile tradeoff to eliminate all horizontal bracing at tent roof edges (e.g., at least the two horizontal poles 4 of FIG. 3 (prior art); and it should be noted that many prior art tent designs actually use four such horizontal bracing components). Finally, since horizontal poles 4 are larger in size than any reasonable hub and are usually made of denser material (e.g., aluminum, which is costly) than typical hub materials, it follows that overall tent size, weight, and cost may all also be reduced by using the present invention 10.

In addition to the above mentioned examples, various other modifications and alterations of the tent pole system 10 without departing from the invention. Accordingly, the above disclosure is not to be considered as limiting and the appended claims are to be interpreted as encompassing the entire spirit and scope of the invention.

INDUSTRIAL APPLICABILITY

The tent pole system 10 according to the present invention is well suited for producing tents with fewer parts, specifically most horizontal tent pole sections may be eliminated. Since the eliminated parts are typically large, of relatively high density, and frequently made of relatively expensive materials (e.g., aluminum or fiberglass) the invention 10 permits lighter and cheaper tent designs. Further, the use of fewer parts makes for simpler tent designs, the assembly, disassembly and storage of which may be more easily grasped by users. Yet another benefit of reduced parts count is that there is less to misplace or lose in tents using the invention 10, thereby reducing the possibilities of needing replacement parts or having to replace an entire tent when replacement parts are unavailable.

The tent pole system 10 according to the present invention is also well suited for producing tents which are strong yet which do not easily transfer forces throughout the tent entire structure, and which rapidly dampen any forces which are applied to the structure of tents using the invention 10. Users will therefore find tents using the present invention 10 more agreeable to use, since shaking, creaking, and vibration (e.g., effects of wind) can be reduced.

For the above, and other, reasons, it is expected that the tent pole system 10 of the present invention will have widespread industrial applicability. Therefore, it is expected that the commercial utility of the present invention will be extensive and long lasting.

I claim:

1. A tent pole system comprising:

a plurality of tent side poles, each having defined therein a bottom end and a top end;

a plurality of tent gable poles, each having defined therein an outer end and an inner end;

a plurality of corner hubs, having two connected tubular members defining an obtuse angle and terminating in a side pole port and a gable pole port, and further having a web between said tubular members of the corner hub;

at least one roof hub, having at least three connected tubular members, each terminating in gable pole ports and each defining obtuse angles respective to the other two said tubular members; wherein said system assembles by inserting said top ends of the tent side poles into said side pole ports of the corner hubs, inserting said outer ends of the gable poles into said gable ports of the corner hubs, and inserting said inner ends of the tent gable poles into said gable pole ports of the roof hub.

2. The tent system of claim 1, wherein:

said web includes an attachment orifice, for connecting tent fabric materials to the tent pole system.

3. The tent pole system of claim 1, wherein said roof hubs further have at least one web between said tubular member of the roof hub.

4. The tent pole system of claim 3, wherein:

said web includes an attachment orifice, for connecting tent fabric materials to the tent pole system.

5. The tent pole system of claim 1, further comprising:

at least one tent ridge pole, for insertion into one of said gable pole ports of a one of said roof hub and insertion into one of said gable pole ports of a second roof hub.

* * * * *